US008628309B2

(12) United States Patent
Nagano et al.

(10) Patent No.: US 8,628,309 B2
(45) Date of Patent: Jan. 14, 2014

(54) TURBOMOLECULAR PUMP DEVICE AND CONTROLLING DEVICE THEREOF

(75) Inventors: Yoshihiro Nagano, Kyoto (JP); Junichiro Kozaki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 587 days.

(21) Appl. No.: 12/750,537

(22) Filed: Mar. 30, 2010

(65) Prior Publication Data

US 2010/0247350 A1 Sep. 30, 2010

(30) Foreign Application Priority Data

Mar. 31, 2009 (JP) ..... 2009-087036

(51) Int. Cl.
*F04B 49/02* (2006.01)
*F04B 49/20* (2006.01)

(52) U.S. Cl.
USPC ..... 417/423.4; 417/423.8; 417/32

(58) Field of Classification Search
USPC ..... 417/423.4, 423.8, 32, 33
See application file for complete search history.

(56) References Cited

U.S. PATENT DOCUMENTS 4,143,309 A * 3/1979 Patterson ..... 318/807
5,971,725 A * 10/1999 de Simon et al. ..... 417/423.8
6,599,108 B2 * 7/2003 Yamashita ..... 417/423.4

FOREIGN PATENT DOCUMENTS

JP 2002-285993 A 10/2002

* cited by examiner

*Primary Examiner* — Charles Freay
*Assistant Examiner* — Philip Stimpert
(74) *Attorney, Agent, or Firm* — McDermott Will & Emery LLP

(57) ABSTRACT

A turbomolecular pump having a pump main unit having, at least, a rotary vein provided on a rotor, a static vein for working in cooperation with the rotary vein to perform a vacuum exhaust, and a motor for driving the rotor, comprising: a controlling device that includes a motor driving circuit for converting into thermal energy, in a regenerative braking resistance, the regenerative electric current that is produced at the time of regeneratively driving the motor; and a cooling device for cooling the controlling device. A rod-shape heating resistive element is used as the regenerative braking resistance, where this resistive heating element is routed along the inner peripheral surface of an end portion 14*a* of the controlling device case that contacts the cooling device.

8 Claims, 9 Drawing Sheets

TURBOMOLECULAR PUMP DEVICE AND CONTROLLING DEVICE THEREOF

CROSS REFERENCE TO RELATED APPLICATIONS

The present application claims priority under 35 U.S.C. §119 to Japanese Patent Application No. 2009-087036, filed Mar. 31, 2009, which is incorporated herein by reference.

FIELD OF TECHNOLOGY

The present invention relates to a turbomolecular pump device and to a controlling device thereof.

BACKGROUND OF THE INVENTION

A turbomolecular pump device exhausts air molecules through the high-speed rotation of a rotary vane relative to a static vane through a rotor, wherein a rotary vein is formed, being driven rotationally by a motor. This type of turbomolecular pump device is connected to a variety of vacuum processing devices for use. When the rotor is stopped in a turbomolecular pump, regenerative electric power from the regenerative driving of the motor is converted into heat energy in regenerative braking resistances to enhance the rotor stopping performance (in, for example, Japanese Unexamined Patent Application Publication 2002-285993 ("JP '993")).

The regenerative braking resistance disclosed in the aforementioned JP '993 has large external dimensions, using a cylindrical coil resistors or block resistors. Consequently, when a braking resistance is disposed within the power supply device case, the case must be made larger, becoming an impediment to the miniaturization of the power supply.

Note that while JP '993 discloses an invention wherein a heater for preventing the adherence of products within the pump is used also as the braking resistance at the time of regeneration, in the present invention the object is different, as the object is to miniaturize the device when that the regenerative braking resistance is disposed within the power supply device.

SUMMARY OF THE INVENTION

A turbomolecular pump device according to the invention includes a pump main unit having a rotary vein provided on a rotor, a static vein that works in cooperation with the rotary vein to perform a vacuum exhaust, and a motor for driving the rotor; a controlling device, housed within a controlling device case, that includes a motor driving circuit for converting into heat energy, using a regenerative braking resistance, regenerative electric current that is produced when regeneratively driving the motor; and a cooling device for cooling the controlling device, interposed between the pump main unit and the controlling device; wherein: the regenerative braking resistance is a rod-shape heating resistive element; and this heating resistive element is disposed routed along the inner peripheral surface of an end portion wherein the controlling device case contacts the cooling device.

The turbomolecular pump device as set forth above further includes a retaining member for retaining the regenerative braking resistance so as to conduct heat to the cooling device.

The turbomolecular pump device as set forth above further has a retaining member for retaining the regenerative braking resistance so as to thermally insulate from the cooling device.

The turbomolecular pump device as set forth above, wherein the regenerative braking resistance is a sheath heater.

A controlling device used in a turbomolecular pump has a rotary vein provided on a rotor, a fixed vane that works in coordination with the rotary vein to perform a vacuum exhaust, and a motor for driving the rotor. This controlling device has a motor driving circuit for converting the regenerative electric current, produced at the time of regeneratively driving the motor, into heat energy in a regenerative braking resistance, and a case for housing of the motor driving circuit; structured such that: the regenerative braking resistance is a rod-shape heating resistive element; the heating resistive element is routed along the inner peripheral surface of the case; and the regenerative electric current flows through the heating resistive element.

A turbomolecular pump device as set forth above, wherein the heating resistive element is routed so as to be in contact with the surface along one or more edges formed from two faces, of the top face, the bottom face, and a side face, of the case.

The invention as set forth above, wherein the regenerative braking resistance is a sheath heater.

A controlling device of any one of the above embodiments, wherein the motor driving circuit includes a three-phase inverter circuit; further comprising: a cooling device for cooling the three-phase inverter circuit; and a retaining member for conducting to the cooling device the heat that is produced by the heating resistive element.

In the present invention a long and thin rod-shaped heating resistive member is disposed routed into a corner portion within a case, thereby increasing the device space efficiency of the heating resistive element within the case, enabling miniaturization of the controlling device case.

DETAILED DESCRIPTION OF THE INVENTION

A turbomolecular pump device 10 according to the present invention will be explained in reference to FIG. 1 through FIG. 10. The turbomolecular pump device exhausts air molecules through the high-speed rotation of a rotary vein relative to a static vein through a rotor on which the rotary vein is formed, driven rotationally by a motor. This type of turbomolecular pump device can be connected to a variety of vacuum processing devices for use.

Figure 1:
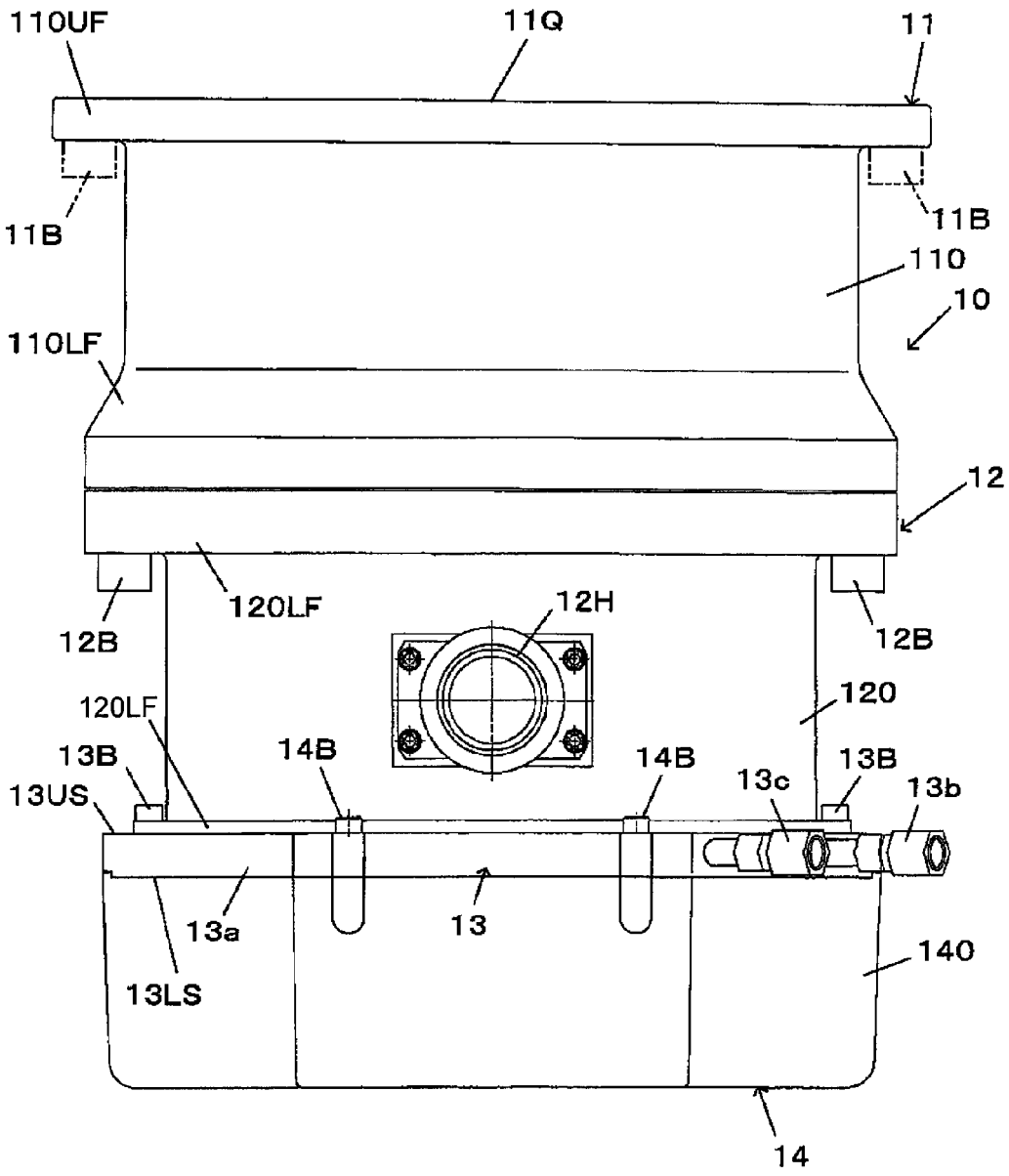
FIG. 1 is an external view of a turbomolecular pump device.

FIG. 1 illustrates an outside view of a turbomolecular pump device 10 that is one example of embodiment according to the present invention. The turbomolecular pump device 10 comprises a pump main unit 11 that performs a vacuum exhaust, a base 12 (also "exhaust portion"), a cooling device 13, and a controlling device 14 (hereinafter termed a "power supply device") for controlling the driving of the pump main unit 11. The pump main unit 11 is a of a well-known structure, and thus the detailed description thereof is omitted; however, typically it includes a rotary unit that is structured from a rotary shaft and a rotor that is provided with a rotary vein, a static vein that works in coordination with the rotary vein, and a motor for driving the rotary unit rotationally. The rotary unit is non-contact supported by electromagnets that structure a five-axis magnetic bearing. The rotary unit that is magnetically levitated by the magnetic bearing so as to be able to rotate freely is driven rotationally at high speeds by the motor to cause the rotary vein to rotate at high speeds relative to the static vein to draw air molecules from a vacuum processing device (not shown) that is attached to an inlet port 11Q, to be exhausted from an exhaust port 12H, to which a back port is attached.

The cooling device 13 is interposed between the pump main unit 11 and the power supply device 14, and cools the heat-producing members within the power supply device 14, and in particular, cools the electronic components of the motor driving circuit. As is illustrated in FIG. 2, the cooling device 13 has a jacket main unit 13*a*, having cooling water ducts formed therein, and a cooling water inlet 13*b* and cooling water outlet 13*c* for circulating cooling water from a pump, not shown, to the cooling water ducts.

The pump main unit 11 comprises a casing 110, where, in FIG. 1, the casing 110 is provided with flanges 110UF and 110LF for connecting at the top and the bottom. The base 12 comprises a casing 120, where the casing 120, in FIG. 1, is provided with flanges 120UF and 120LF for connecting at the top and the bottom. The casings 110 and 120 shall be termed the "pump casing." The upper connecting flange 110UF of the pump main unit 11 is connected by bolts 11B to the exhaust opening of a vacuum processing device, not shown. The lower connecting flange 110LF of the pump main unit 11 is connected by bolts 12B to the upper connecting flange 120UF of the base 12. The lower connecting flange 120LF of the base 12 is provided on the upper surface 13US of the cooling device 13, where the cooling device 13 is connected by bolts 13B to the lower surface of the base 12. The lower surface of the cooling device 13 is in contact with the upper end surface of a case 140 of the power supply device 14, where the power supply device 14 is connected by bolts 14B to the cooling device 13 through the case 140.

Figure 2:
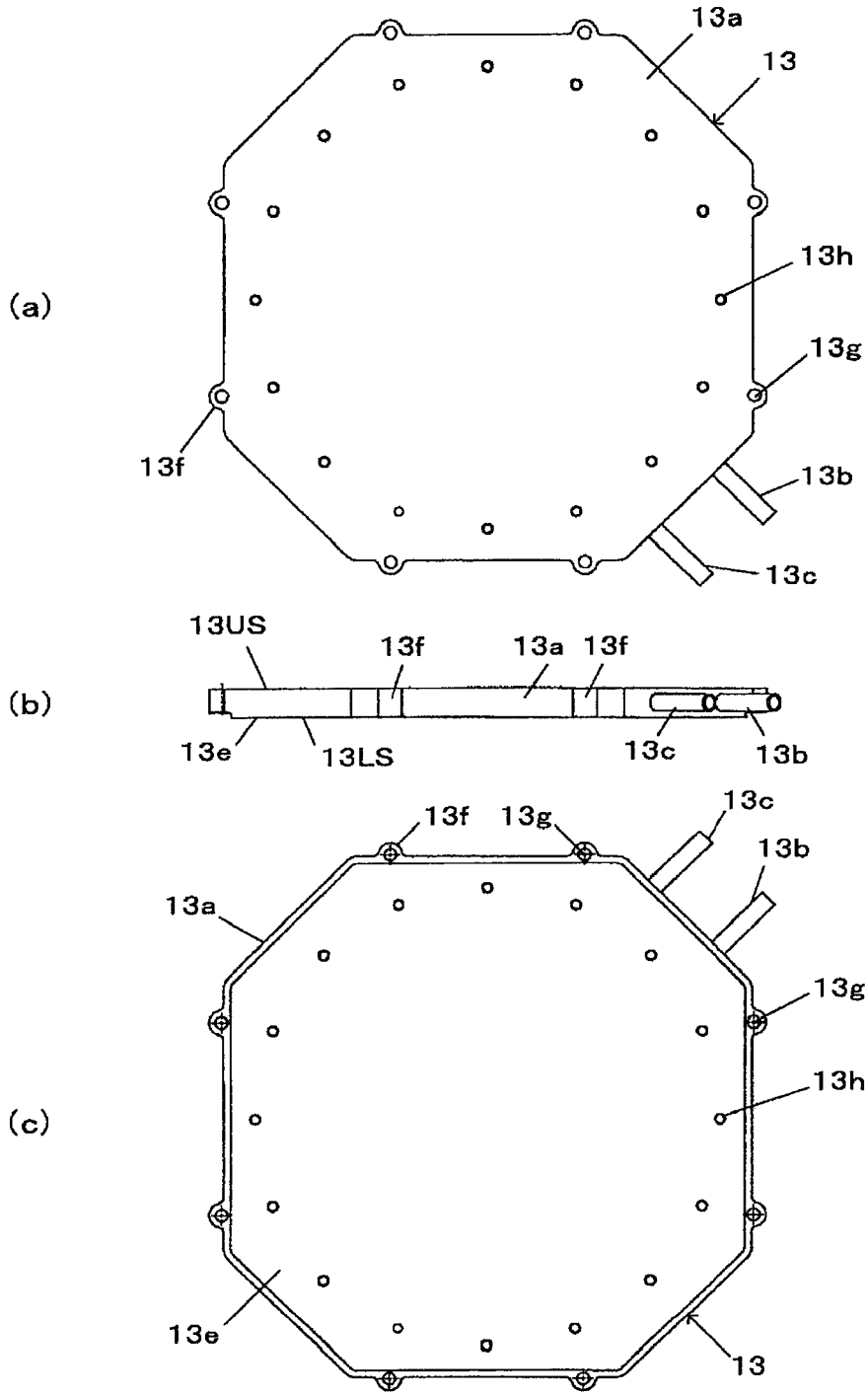
FIG. 2 is diagrams for explaining a water-cooling jacket, wherein (a) is a plan view, (b) is a front view, and (c) is a bottom view.

As illustrated in FIG. 2, the planer shape of the jacket main unit 13*a* is essentially octagonal, where a raised portion 13*e*, having a planer shape that is essentially octagonal, is formed on a bottom surface. Protrusions 13*f* are formed at specific angular intervals on the outer periphery of the jacket main unit 13*a*, where holes 13*g* are formed in these protrusions 13*f* for connecting the power supply device case 140. Screw holes 13*h* are formed threaded in the raised portions 13*e* so as to form a circle that is concentric with the pump rotational axis. As illustrated in FIG. 1, the jacket upper surface 13US contacts the lower connecting flange 120LF of the casing 120 of the base 12, and bolts 13B are screwed into the screw holes 13*h* to connect the casing 120 to the jacket main unit 13*a*. The upper surface of the power supply device case 140 contacts the lower surface 13LS of the jacket main unit 13*a* and bolts 14B are screwed into screw holes of the power supply device case 140 to connect the power supply device 14 to the jacket main unit 13*a*.

Figure 3:
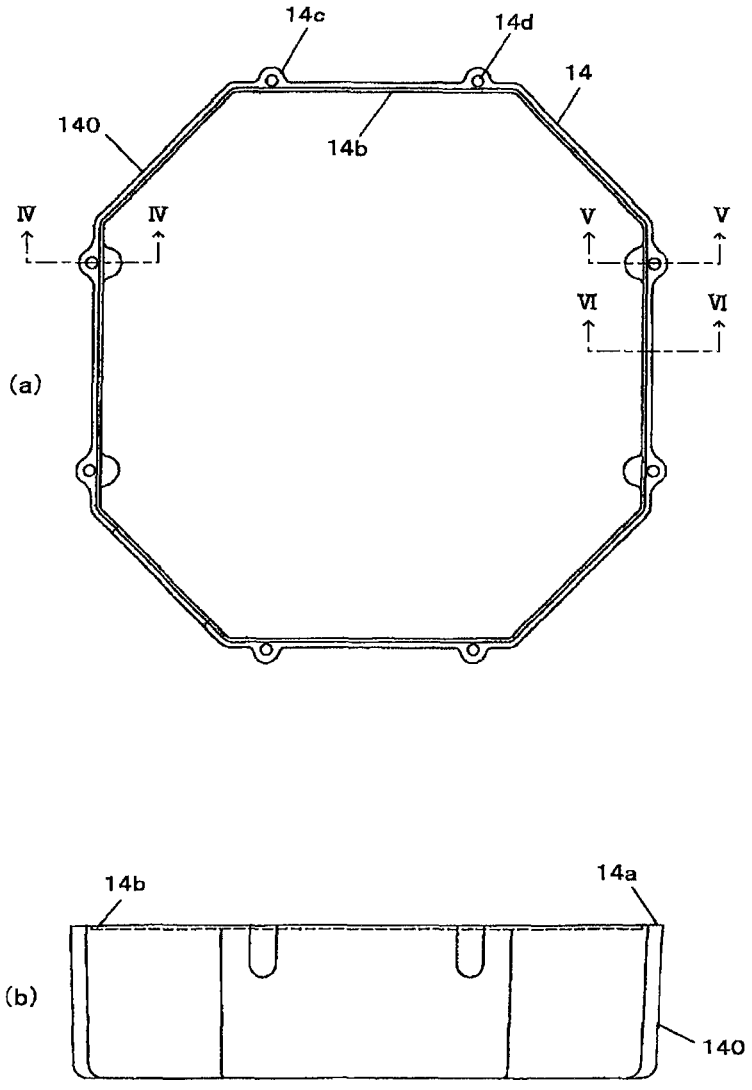
FIG. 3 is diagrams for explaining a power supply device case, wherein (a) is a plan view and (b) is a front view.
Figure 4:
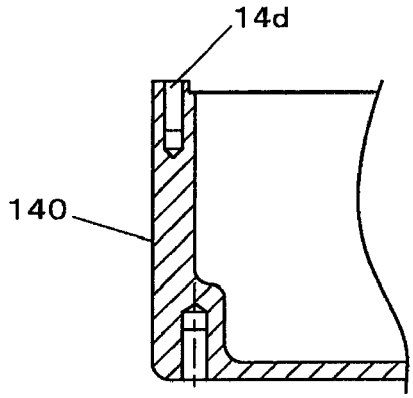
FIG. 4 is a cross-sectional diagram along the section IV-IV in FIG. 3.
Figure 5:
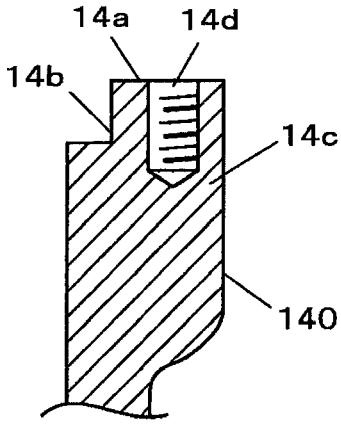
FIG. 5 is a cross-sectional diagram along the section V-V in FIG. 3
Figure 6:
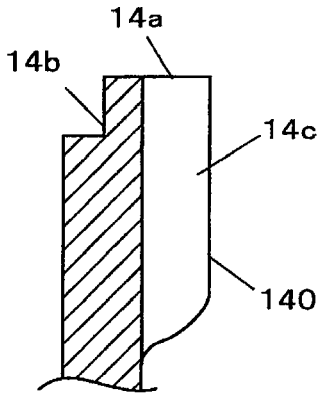
FIG. 6 is a cross-sectional diagram along the section VI-VI in FIG. 3.
Figure 7:
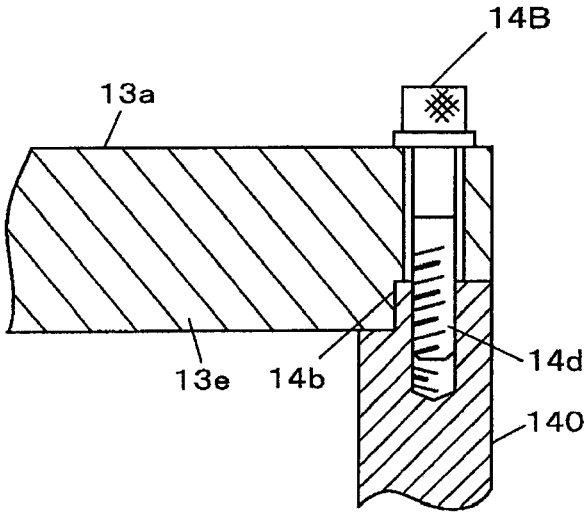
FIG. 7 is a diagram for explaining the structure wherein a jacket main unit and the power supply device case are fitted together.

The power supply device case 140 will be described in reference to FIG. 3. The power supply device case 140 is formed as an octagonal cylinder with a bottom (FIG. 4), where, as illustrated in the expanded views in FIG. 5 and FIG. 6, an essentially octagonal ring-shaped recessed portion 14*b* is provided around the entire periphery at the open end 14*a* thereof. Protrusions 14*c* are formed at specific angular intervals around the outer periphery of the open end 14*a*, where screw holes 14*d*, for fastening the power supply device case 140 and the jacket main unit 13*a*, are provided threaded in the protrusions 14*c*. As illustrated in FIG. 7, a raised portion 13*e* of the jacket main unit 13*a* fits onto the ring-shaped recessed portion 14*b*. That is, the octagonal peripheral edge of the raised portions 13*e* of the cooling device 13 fits into the essentially identically octagonally-shaped recessed portion 14*b*.

Figure 8:
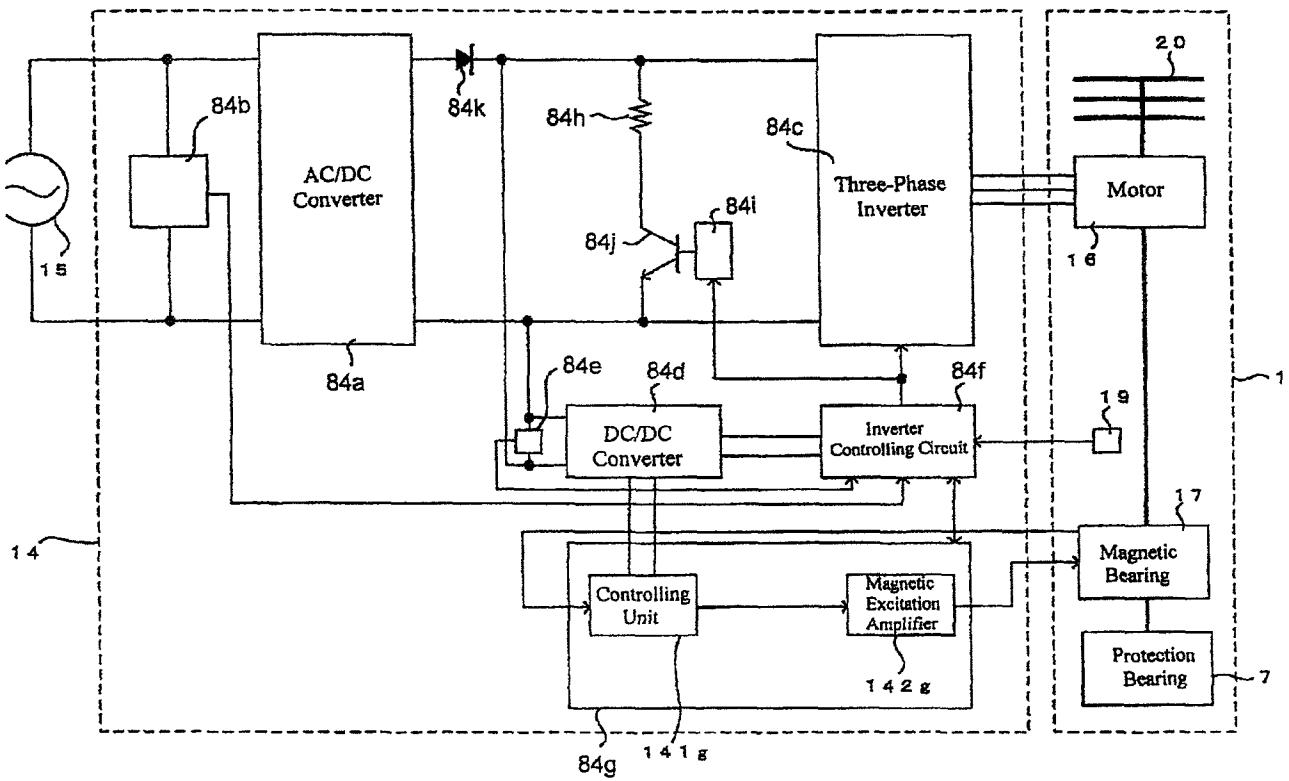
FIG. 8 is a block diagram illustrating the details of the controlling device 14.

The power supply device 14 will be described in reference to FIG. 8. An alternating current power is provided from the primary power supply 15 to the power supply device 14, and is inputted into the AC/DC converter 84*a*. The voltage of the inputted alternating current power is detected by a voltage sensor 84*b*. The AC/DC converter converts the alternating current power, supplied from the primary power supply 15, into direct current power. The direct current power that is outputted from the AC/DC converter 84*a* is inputted into a three-phase inverter 84*c*, for driving the motor 16, and a DC/DC converter 84*d*. The voltage of the direct current power that is inputted into the DC/DC converter 84*d* is detected by a voltage sensor 84*e*. The output of the DC/DC converter 84*d* is inputted into an inverter controlling circuit 84*f* for controlling the three-phase inverter 84*c* using, for example, PWM control, and into a magnetic bearing controlling unit 84*g* for controlling the magnetic levitation by the magnetic bearing 17.

The magnetic bearing controlling unit 84*g* comprises a controlling unit 141*g* for performing the bearing control, and a magnetic excitation amplifier 142*g* for providing, to the magnetic bearing 17, a magnetic excitation current based on a control signal calculated by the controlling unit 141*g*.

The frequency of the rotor 20, detected by a frequency sensor 19, is inputted into the inverter controlling circuit 84*f*, and the inverter controlling circuit 84*f* controls the three-phase inverter 84*c* based on the rotor frequency. Additionally, 84*h* is a regenerative braking resistance for consuming regenerated excess power, where the power that is regenerated during rotor deceleration is consumed in the regenerative braking resistance 84*h*. The current that flows into the regenerative braking resistance 84*h* is controlled through a transistor controlling circuit 84*i* turning a transistor 84*j* ON/OFF. 84*k* is a diode for preventing the reverse flow of power at the time of regeneration.

Figure 9:
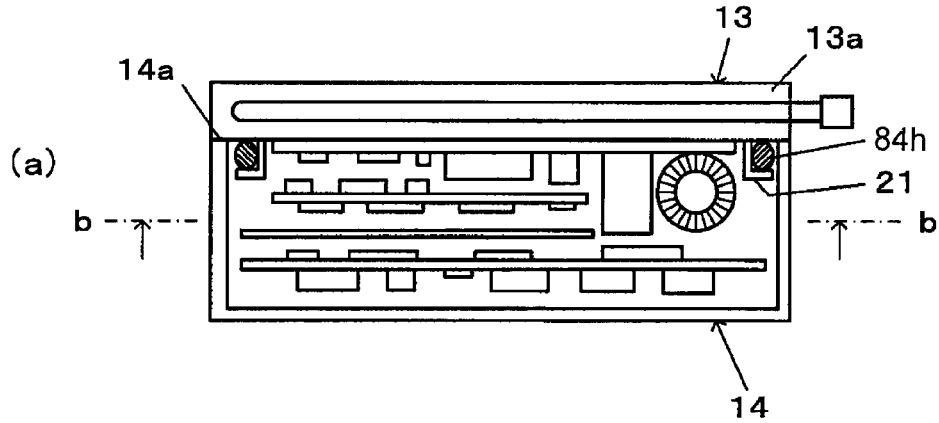
FIG. 9 (*a*) is a vertical sectional diagram illustrating the interior of the case 140, and (*b*) is a cross-sectional diagram along the section b-b of the device.
Figure 9:
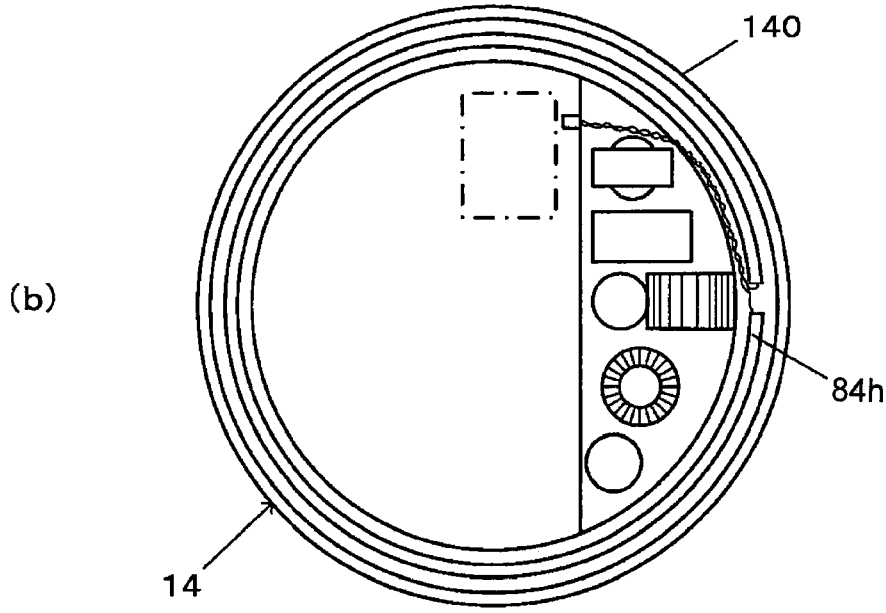

FIG. 9 is a diagram illustrating a specific configuration for elements and substrates in the power supply device 14. FIG. 9 (*a*) is a vertical sectional diagram of the jacket main unit 13*a* and the power supply device 14, where FIG. 9 (*b*) is a cross-sectional diagram along the section b-b in FIG. 9 (*a*). As described using FIG. 8, the power supply device 14 is provided with, primarily, a motor driving circuit unit and a magnetic bearing controlling unit, where, as illustrated in FIG. 9 (*a*), the various elements are disposed distributed on a plurality of substrates. The motor driving circuit unit is a high current unit for supplying power to the motor, and includes the regenerative braking resistance 84*h*, which is a heating element at the time of regenerating, and thus is disposed directly under the cooling device 13.

Figure 10:
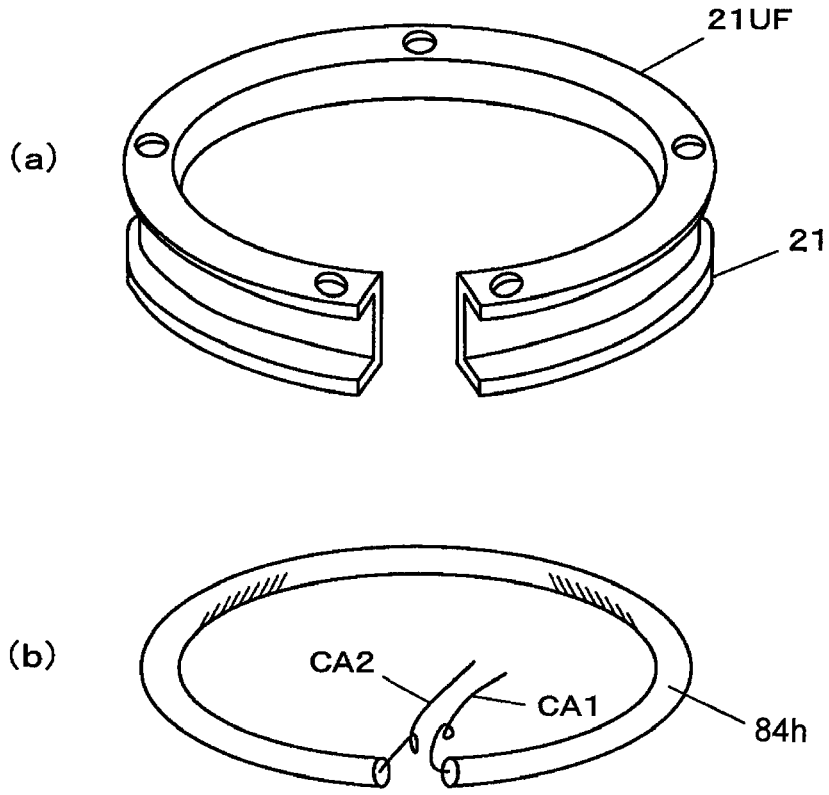
FIG. 10 is a diagram for explaining a bracket for attaching a sheath heater to the cooling device, wherein (*a*) shows an attaching bracket and (*b*) shows an outside view of a regenerative braking resistance.

FIG. 10 (*b*) shows an outside view of the regenerative braking resistance 84*h*, where FIG. 10 (*a*) is an oblique view of an attaching bracket. The regenerative braking resistance 84*h* is, for example, a sheath heater, and is formed as a ring-shaped unit of, for example, a C shape, corresponding to the outside shape of the bottom surface of the jacket main unit 13*a*. One terminal of the regenerative braking resistance 84*h* is connected to the positive line of the AC/DC converter 84*a* through a cable CA1, and the other terminal is connected to the collector terminal of a transistor 84*j* through a cable CA2.

As illustrated in FIG. 10 (*a*), attaching holes are provided in the upper end flange 21UF of the attaching bracket 21, where bolts, not shown, are inserted into these holes to secure the attaching bracket 21 through screwing the bolts into the screw holes of the jacket main unit 13*a*, where the outer diameter of the attaching bracket 21 is somewhat smaller than the inner diameter of the power supply device case 140 and the outer diameter of the jacket main unit 13*a*, so that, as illustrated in FIG. 9 (*a*), it attaches to a corner portion of the inner peripheral surface connection of the open end of the power supply device case 140 that connects to the jacket main unit 13*a*. The sheath heater 84*h* is disposed so as to be routed at the bottom surface of the bracket 21, which has a C-shaped cross section, and is attached by attaching means, not shown. In this way, the sheath heater 84*h* is disposed routed along the inner peripheral surface of the end portion of the case 140 that contacts the cooling device 13. In other words, the sheath heater 84*h* is fabricated in advance in a shape corresponding to the inner peripheral surface of the case 140, and is thus disposed. The space wherein the sheath heater 84*h* is disposed in the case 140, with this cross-sectional shape, is a space wherein elements or substrates for, for example, the motor driving controlling unit or the magnetic bearing controlling unit, or the like, cannot be disposed to begin with. Consequently, this increases the space utilization efficiency for the layout of the various elements in the power supply device case 140, contributing to the miniaturization of the power supply device 14.

The regenerative braking resistance 84*h* is attached to the cooling device 13 through a bracket 21 that is fabricated from a thermally conductive member, and thus, at the time of the regenerative braking, the heat that is produced is conducted to the cooling device 13, suppressing any excessive increase in temperature.

Note that instead of the attaching bracket 21, the sheath heater 84*h* may be attached through a plurality of hardware disposed at specific intervals along the shape of the sheath heater 84*h* to the bottom surface of the jacket main unit 13*a*. In this case, attaching the sheath heater 84*h* to the bottom surface of the jacket main unit 13*a* can improve the thermal conductivity.

In the turbomolecular pump device 10 in one form of embodiment, the jacket main unit 13*a* and the power supply device case 140 fit together through the essentially octagonal raised portion 13*e* and essentially octagonal ring-shaped recessed portion 14*b* forming a torque reaction structure. Thus when the pump casing 110 rotates relative to the vacuum processing device, due to an impact torque when, due to an external noise, the rotor of the pump main unit 11 makes contact with the inner peripheral surface of the pump casing and stops, the inertia due to the mass acts upon the cooling device 13 and the power supply device 14, and a torque, due to the inertia, acts on the connecting portion (a first connecting portion) between the exhaust portion casing 120 and the cooling device 13. Furthermore, a torque due to inertia also acts on the connecting portion (a second connecting portion) between the cooling device 13 and the power supply device case 140. The inertial torque due to the mass of the power supply 14 is transmitted to the octagonal raised portion 13*e* of the jacket main unit 13*a* from the essentially octagonal ring-shaped recessed portion 14*b*. The jacket main unit 13*a* is connected to the exhaust portion casing 120 by the bolts 13B, and thus the sheer force from the initial torque acts on the bolts 13B. The result is that there is no large sheer force, because of the aforementioned inertial forces, on the connecting bolts 14B between the jacket main unit 13*a* and the power supply device case 140. Consequently, the diameter of the bolts 14*b* can be thin because there is no need to consider the inertial torque.

The turbomolecular pump device of the form of embodiment set forth above has the following effects of operation:

Because the sheath heater 84*h*, which is a long and thin rod-shaped heating resistive element, is routed in a corner portion of the case, the space utilization efficiency for the placement of the heating resistive element 84*h* within the case is improved, enabling the controlling device 14 to be miniaturized, contributing, by extension, to the miniaturization of the turbomolecular pump.

Because the regenerative braking resistance 84*h* is held by a retaining member 21 that is made out of a material that has a high thermal conductivity, and thereby attached to the cooling device 13, the heat that is produced during regeneration can be cooled efficiently by the cooling device 13. In particular, a great amount of heat is produced during regenerative braking in a relatively large turbomolecular pump, and thus there is the danger that the temperature of the regenerative braking resistance 84*h* will rise above tolerable values due to the amount of heat when stopping the rotor. Given this, cooling the regenerative braking resistance 84*h* using the cooling device 13 makes it possible to suppress excessive increases in temperature.

Using a sheath heater 84*h* for the regenerative braking resistance facilitates easy fabrication matching the shape of the case. Furthermore, the sheath heater is a shared heater, which can reduce costs and enable miniaturization of the case.

The power supply device 14 in the form of embodiment is structured so as to cause the regeneration electric current to flow in the heating resistive element 84*h*, where this heating resistive element 84*h*, in the case 140 that houses the motor driving circuit, is routed along the inner peripheral surface of the case 140. This enables the case to be made smaller. That is, in a braking resistance that uses a coiled resister of the conventional ring shape, there is a limitation to the locations wherein installation is possible within the case, making miniaturization of the case difficult. However, the use of the rod-shaped heating resistive element as the braking resistance enables the routing of the rod-shaped heating resistive element, which is fabricated in a specific shape in advance, in an empty space that is dead space within the case, enabling the case to be miniaturized.

The heating resistive element 84*h* encompasses the motor driving circuitry, including, for example, the three-phase inverter circuit 84*c*, thus causing a uniform heat distribution within the case, thus preventing localized overheating of the case 140.

Figure 11:
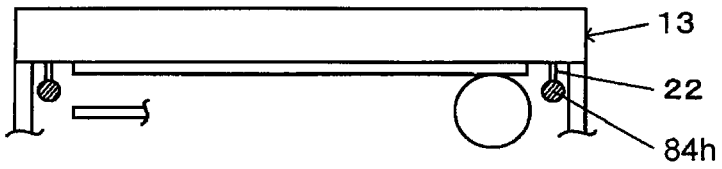
FIG. 11 is a diagram illustrating one example of attaching the sheath heater to the cooling device using a thermally insulating member.

The turbomolecular pump device according to the form of embodiment set forth above can be modified at least as follows:

As illustrated in FIG. 11, the regenerative braking resistance 84*h* may be attached to the cooling device 13 through a thermally insulating member 22. When it comes to the volume of the regenerative braking resistance 84*h*, the rotary unit has kinetic energy, and in a relatively small turbomolecular pump, the thermal energy at the time of regenerative braking is small. Because of this, insofar as it is possible to absorb, in the regenerative braking resistance 84*h*, all of the energy until the rotating member has stopped, there is no need to cool the regenerative braking resistance 84*h*. Given this, in relatively small turbomolecular pumps it is preferable for there to be thermal insulation between the regenerative braking resistance 84*h* and the cooling device 13. Because the heat generated by the regenerative braking resistance 84*h* is not cooled by the cooling device 13, it is possible to cool efficiently, through the cooling device 13, the motor driving circuits such as the inverter circuits, or the like.

Figure 12:
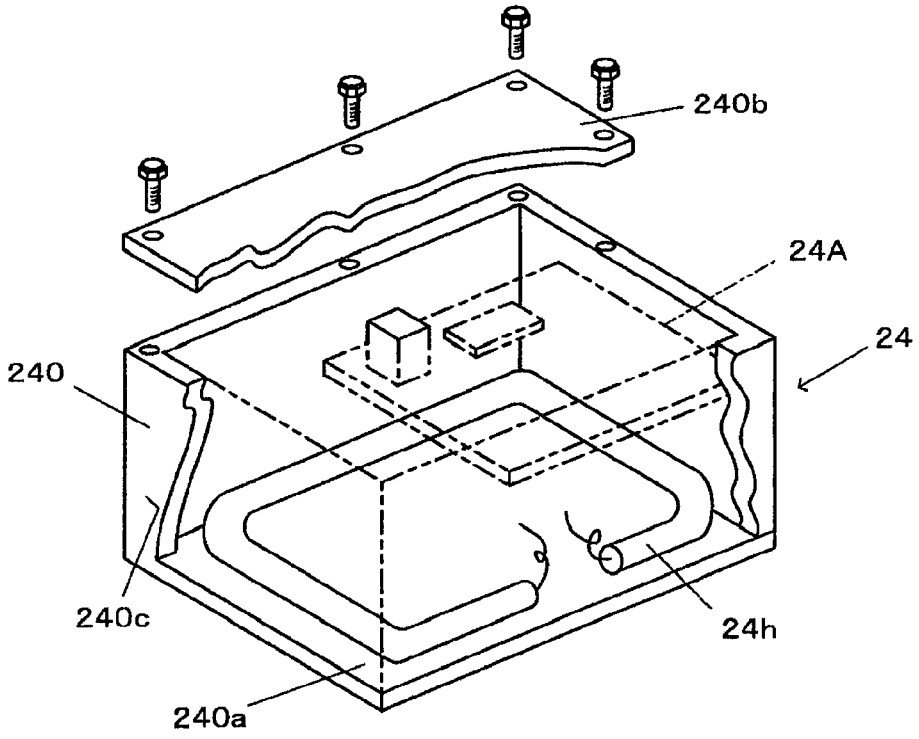
FIG. 12 is a diagram illustrating one example of a power supply device that is provided separately from the pump main unit.

While the explanation above was for a turbomolecular pump wherein the cooling device 13 and the power supply device 14 were integrated and connected to the pump main unit 11 and the base 12, the controlling device according to the present invention can be implemented also as a power supply device 24 that is provided separately from the turbomolecular pump. In such a case, as illustrated in FIG. 12, the power supply device case 240 may be structured from thin plate material to form a space of a rectangular prism, with one plane for partitioning the inner space, where, as illustrated in FIG. 12, a sheath heater 24*h* may be disposed in a ring shape (a C shape), as the regenerative braking resistance 24*h*, so as to contact the bottom surface 240*a* along the four edges of the bottom surface 240*a*. That is, the regenerative braking resistance 24*h* may be disposed in contact with the bottom surface 240*a* and the side surface 240*c* of the power supply device case 240 to cause the heat that is generated at the time of regenerative braking to be conducted to the thin plate material, to dissipate the heat from the outside of the case that is made from the thin plate material.

Note that in the power supply device of FIG. 12, the sheath heater 24*h* may be disposed in the vicinity of the top surface of the case 240.

While in the power supply device 24 illustrated in FIG. 12 it is not necessary to cool, using a cooling device, the regenerative braking resistance 24*h*, if, as described above, the amount of heat that is produced from the regenerative braking resistance 24*h* before the rotary unit stops is relatively large, such as in a relatively large turbomolecular pump, then preferably a cooling device should be provided in the case 240 for cooling the regenerative braking resistance 24*h*. Note that in FIG. 12 24A indicates a substrate, such as in inverter circuit, and 240*b* is a top cover for the case 240.

In the controlling device in FIG. 12, described above, the heating resistive element 24*h* is disposed routed along the four edges of the bottom surface 240*a* of the case 240. As a result, the heat that is generated by the heating resistive element 24*h* is dissipated to the outside of the case through the side surface 240*c* and the bottom surface 240*a* that structure the case 240.

In the controlling device in FIG. 12, the heating resistive element may be disposed so as to contact the surface along the edge that is formed with the side surface of the case 240.

While the cooling device 13 was of a water-cooling type, it may instead be of an air-cooling type.

While a sheath heater 84*h* or 24*h* was used as the regenerative braking resistance, there is no limitation to a sheath heater insofar as it is a rod-shaped heating resistive element that can be formed into a ring.

While in the turbomolecular pump device illustrated in FIG. 1 through FIG. 7, a torque reaction structure was provided as a recessed portion and raised portion fitting structure applied to the connecting portion between the pump main unit 11 and the base 12, the connecting portion between the base 12 and the cooling device 13, and the connecting portion between the cooling device 13 and the power supply device 14, the present invention can also be applied to a turbomolecular pump device that is not provided with a torque reaction structure.

The various forms of embodiment set forth above may be used either singly or in combination. This is because the effects of the various forms of embodiment can be claimed either singly or synergistically. Additionally, insofar as the distinctive features of the present invention are not lost, the present invention is in no wise limited to the forms of embodiment set forth above. For example, the present invention can be applied to a turbomolecular pump device that is not of a magnetic bearing type.

The invention claimed is:

1. A turbomolecular pump device comprising:

a pump main unit having a rotary vein provided on a rotor, a static vein that works in cooperation with the rotary vein to perform a vacuum exhaust, and a motor for driving the rotor;

a controlling device, housed within a controlling device case, that includes a motor driving circuit for converting into heat energy, using a regenerative braking resistance, regenerative electric current that is produced when regeneratively driving the motor; and a cooling device for cooling the controlling device, interposed between the pump main unit and the controlling device; wherein:

the regenerative braking resistance is a rod-shape heating resistive element; and the heating resistive element is disposed routed along the inner peripheral surface of an end portion of the controlling device case, the portion being in contact with the cooling device.

2. A turbomolecular pump device as set forth in claim 1, further comprising:

a retaining member for retaining the regenerative braking resistance so as to conduct heat to the cooling device.

3. A turbomolecular pump device as set forth in claim 1, further comprising:

a retaining member for retaining the regenerative braking resistance so as to thermally insulate from the cooling device.

4. A turbomolecular pump device as set forth in claim 1, wherein:

the regenerative braking resistance is a sheath heater.

5. A turbomolecular pump controlling device used in a turbomolecular pump having a rotary vein provided on a rotor, a static vein that works in coordination with the rotary vein to perform a vacuum exhaust, and a motor for driving the rotary vein, comprising:

a motor driving circuit for converting into thermal energy in a regenerative braking resistance the regenerative electric current produced when regeneratively driving the motor; and a case for housing the motor driving circuit, wherein:

the regenerative braking resistance is a rod-shape heating resistive element;

the heating resistive element is routed along the inner peripheral surface of the case; and the regenerative electric current flows through the heating resistive element.

6. A turbomolecular pump device as set forth in claim 5, wherein:

the heating resistive element is routed so as to be in contact with the surface along one or more edges formed from two faces, of a top face, a bottom face, and a side face, of the case.

7. A turbomolecular pump device as set forth in claim 5, wherein:

the regenerative braking resistance is a sheath heater.

8. A controlling device of claim 5, wherein:

the motor driving circuit includes a three-phase inverter circuit; further comprising:

a cooling device for cooling the three-phase inverter circuit; and a retaining member for conducting to the cooling device the heat that is produced by the heating resistive element.

* * * * *